US011419384B2

(12) United States Patent
Bryer

(10) Patent No.: US 11,419,384 B2
(45) Date of Patent: Aug. 23, 2022

(54) SHOE FOR SIMULATING EXERCISING ON NATURAL GRANULAR MATERTIAL

(71) Applicant: Benjamin Ari Bryer, Westport, CT (US)

(72) Inventor: Benjamin Ari Bryer, Westport, CT (US)

( * ) Notice: Subject to any disclaimer, the term of this patent is extended or adjusted under 35 U.S.C. 154(b) by 177 days.

(21) Appl. No.: 16/775,954

(22) Filed: Jan. 29, 2020

(65) Prior Publication Data

US 2020/0253318 A1 Aug. 13, 2020

Related U.S. Application Data

(60) Provisional application No. 62/802,659, filed on Feb. 7, 2019.

(51) Int. Cl.
*A43B 1/10* (2006.01)
*A43B 1/00* (2006.01)

(52) U.S. Cl.
CPC ..... *A43B 1/0018* (2013.01); *A43B 1/10* (2013.01)

(58) Field of Classification Search
CPC ..... A43B 1/0018; A43B 1/10; A43B 19/00; A43B 5/18; A43B 3/244; A43B 7/148; A43B 7/005; A43B 7/1465
USPC ..... 36/84
See application file for complete search history.

(56) References Cited

U.S. PATENT DOCUMENTS 3,399,470 A * 9/1968 Schofield ..... A43B 3/16 36/7.1 R
4,170,078 A 10/1979 Moss
4,297,797 A 11/1981 Meyers
4,431,003 A 2/1984 Sztancsik
4,445,283 A 5/1984 Meyers
4,697,361 A 10/1987 Ganter et al.
4,794,707 A 1/1989 Franklin et al.
4,934,073 A * 6/1990 Robinson ..... A43B 5/00 482/79
5,155,927 A 10/1992 Bates et al.
(Continued)

FOREIGN PATENT DOCUMENTS

DE 4202159 A1 7/1993

OTHER PUBLICATIONS

Mike, Inc., Nike Joyride web page, web address: www.nike.com/US/en_us/c/innovation/joyride, Nike, Inc. 2020.
(Continued)

*Primary Examiner* — Timothy K Trieu
(74) *Attorney, Agent, or Firm* — Luccarelli & Musacchio LLP; Pasquale Musacchio

(57) ABSTRACT

A shoe for simulating exercising on natural granular material. The shoe includes a shoe upper, a shoe outsole and a flexible midsole guard element that forms a chamber between the shoe upper and the outsole. The shoe further includes at least one bladder located in the chamber and that is attached to the shoe upper. The bladder includes synthetic granular material having a simulation distribution of synthetic granular material for simulating exercising on natural granular material. The bladder is compressed by the shoe upper during exercise to displace the synthetic granular material wherein the bladder is subsequently expanded by upward movement of the shoe upper during exercise to redistribute the synthetic granular material and again form a simulation distribution of synthetic granular material.

9 Claims, 6 Drawing Sheets

(56) References Cited

U.S. PATENT DOCUMENTS

| | | | | |
|---|---|---|---|---|
| 5,694,704 | A * | 12/1997 | Kasbrick | A43B 3/16 36/59 R |
| 5,718,063 | A | 2/1998 | Yamashita | |
| 6,312,361 | B1 | 11/2001 | Hayes | |
| 6,782,639 | B1 | 8/2004 | Muller | |
| 6,922,918 | B2 * | 8/2005 | Issler | A43B 17/102 36/71 |
| 2004/0159014 | A1 * | 8/2004 | Sommer | A43B 21/265 36/28 |
| 2005/0060915 | A1 * | 3/2005 | Drennan | A43B 13/20 36/110 |
| 2005/0086838 | A1 | 4/2005 | Khantzis | |
| 2005/0150132 | A1 | 7/2005 | Iannacone | |
| 2006/0253962 | A1 * | 11/2006 | Hua | A41B 11/02 2/239 |
| 2007/0011917 | A1 | 1/2007 | Hayes | |
| 2007/0180734 | A1 | 8/2007 | Foster | |
| 2009/0100719 | A1 | 4/2009 | Pierre | |
| 2009/0100720 | A1 | 4/2009 | Pierre | |
| 2009/0126233 | A1 | 5/2009 | Rastegar | |
| 2009/0265961 | A1 * | 10/2009 | Muller | A43B 3/24 36/3 A |
| 2010/0050478 | A1 | 3/2010 | DiBenedetto et al. | |
| 2011/0092339 | A1 | 4/2011 | Stewart | |
| 2011/0131834 | A1 | 6/2011 | Shibata | |
| 2011/0192053 | A1 * | 8/2011 | Beers | A43B 3/001 36/103 |
| 2013/0340287 | A1 | 12/2013 | Stewart | |
| 2014/0052031 | A1 | 2/2014 | Rastegar | |
| 2014/0336008 | A1 | 11/2014 | Stewart | |
| 2016/0067550 | A1 | 3/2016 | Breach et al. | |
| 2016/0074700 | A1 | 3/2016 | Stewart | |
| 2016/0271442 | A1 | 9/2016 | Stewart | |
| 2017/0280682 | A1 | 10/2017 | Ruetenik | |
| 2018/0104536 | A1 | 4/2018 | Stewart | |
| 2018/0140041 | A1 | 5/2018 | Comstock et al. | |
| 2018/0290013 | A1 | 10/2018 | Stewart | |

OTHER PUBLICATIONS

Puma, printout of web page entitled "Jamming is PUMA's new Sole Technology for ultimate comfort—PUMA CATch up", web address: www.puma-catchup.com/jamming-pumas-new-sole-technology-ultimate-comfort/, Nov. 9, 2017, Puma Se, Herzogenaurach.

Riley Jones, printout of web page entitled Nike Addresses Joyride Comparisons to Puma's Jamming Tech, web address: //solecollector.com/news/2019/08/nike-addresses-joyride-comparisons-puma-jamming, Sole Collector, Aug. 7, 2019, Complex Media 2020.

Leila, Pulptastic web page entitled "These Amazing Japanese-Inspired Shoes Literally Wrap Around Your Feet", web address: //pulptastic.com/these-amazing-japanese-inspired-shoes-literally-wrap-around-your-feet/, Pulptastic 2020.

* cited by examiner

SHOE FOR SIMULATING EXERCISING ON NATURAL GRANULAR MATERTIAL

PRIORITY CLAIM

This application claims the benefit under 35 U.S.C. § 119(e) of U.S. Provisional Application No. 62/802,659 filed on Feb. 7, 2019 and entitled SHOE FOR SIMULATING EXERCISING ON NATURAL GRANULAR MATERIAL, which is incorporated herein by reference in its entirety and to which this application claims the benefit of priority.

TECHNICAL FIELD

Aspects of the present invention relate to a shoe for simulating exercising on natural granular material, and more particularly, to a shoe having at least one bladder that includes a synthetic granular material having a simulation distribution of synthetic granular material for simulating exercising on natural granular material wherein the bladder is compressed by a shoe upper during exercise to displace the synthetic granular material and wherein the bladder is subsequently expanded by upward movement of the shoe upper during exercise to redistribute the synthetic granular material and again form a simulation distribution of synthetic granular material.

BACKGROUND

Several types of footwear exist that are used during exercise activities. Some footwear, such as athletic training footwear, is designed to provide comfort and help tone leg muscles during training, for example. A type of training method includes exercising or running in relatively deep sand, such as running on a beach, wherein a person's forefoot sinks into the sand during a push-off portion of a stride. When this occurs, the sand tends to displace and redistribute thereby decreasing surface resistance to the foot's motion and the ability to obtain traction when pushing off the ground. This causes the runner's leg muscles to work harder during the stride. As a running surface, sand helps develop strength and endurance as lower leg muscles, ligaments and tendons work against the decreased resistance provided by the sand. Running on sand provides a more intense and demanding cardiovascular workout when compared to running on a relatively hard surface such as a running track surface or a paved road. It is desirable to provide athletic training footwear, usable on a hard surface, that provides substantially all of the training benefits of running on a sand-like surface, such as a beach, when a sand-like surface is not available.

SUMMARY OF THE INVENTION

A shoe for simulating exercising on natural granular material is disclosed. The shoe includes a shoe upper, a shoe outsole and a flexible midsole guard element that forms a chamber between the shoe upper and the outsole. The shoe further includes at least one bladder located in the chamber and attached to the shoe upper. The bladder includes synthetic granular material having a simulation distribution of synthetic granular material for simulating exercising on natural granular material. The bladder is compressed by the shoe upper during exercise to displace the synthetic granular material wherein the bladder is subsequently expanded by upward movement of the shoe upper during exercise to redistribute the synthetic granular material and again form a simulation distribution of synthetic granular material.

In an alternate embodiment, a shoe attachment is disclosed for simulating exercising on natural granular material. The shoe attachment includes a bladder having synthetic granular material that includes a simulation distribution of synthetic granular material for simulating exercising on natural granular material. The bladder is compressed by the shoe during exercise to displace the synthetic granular material. The bladder is subsequently expanded by upward movement of the shoe during exercise to redistribute the synthetic granular material and again form a simulation distribution of synthetic granular material. The shoe attachment further includes a covering that receives the bladder, wherein the covering includes a shoe pocket that receives a front portion of the shoe and a heel strap that receives a heel portion of the shoe. In addition, the shoe attachment includes first and second extension wings that extend from the covering, wherein the first wing is wrapped around the shoe in a first direction and the second wing is wrapped around the shoe in a second direction thereby attaching the shoe.

An alternate embodiment is also disclosed for a shoe for simulating exercising on natural granular material. The shoe includes a shoe upper, a shoe outsole and a flexible midsole guard element that forms a chamber between the shoe upper and the outsole. The shoe further includes at least one bladder located in the chamber and attached to the shoe upper. The bladder includes synthetic granular material having a simulation distribution of synthetic granular material for simulating exercising on natural granular material. The bladder is compressed by the shoe upper during exercise to displace the synthetic granular material wherein the bladder is subsequently expanded by upward movement of the shoe upper during exercise to redistribute the synthetic granular material and again form a simulation distribution of synthetic granular material. Further, a rear portion of the shoe includes an aperture that provides access to the chamber to enable insertion of the bladder into the chamber via the aperture.

Those skilled in the art may apply the respective features of the present invention jointly or severally in any combination or sub-combination.

BRIEF DESCRIPTION OF THE DRAWINGS

The exemplary embodiments of the invention are further described in the following detailed description in conjunction with the accompanying drawings, in which.

To facilitate understanding, identical reference numerals have been used, where possible, to designate identical elements that are common to the figures. The figures are not drawn to scale.

DETAILED DESCRIPTION

Figure 1:
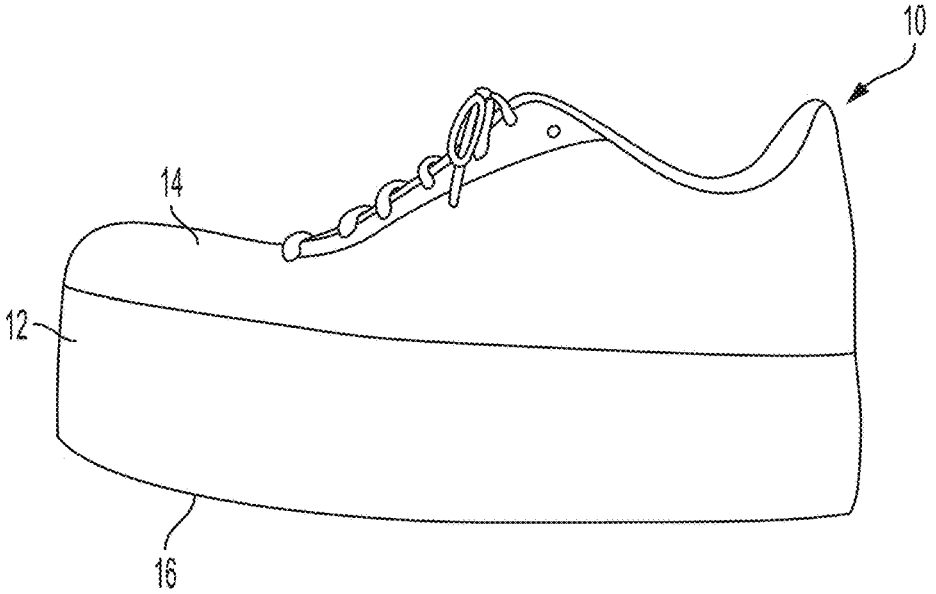
FIG. 1 is a side view of a shoe that simulates exercising on granular material in accordance with the invention.

Although various embodiments that incorporate the teachings of the present disclosure have been shown and described in detail herein, those skilled in the art can readily devise many other varied embodiments that still incorporate these teachings. The scope of the disclosure is not limited in its application to the exemplary embodiment details of construction and the arrangement of components set forth in the description or illustrated in the drawings. The disclosure encompasses other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Aspects of the invention are directed to footwear that simulates walking, jogging, jumping and/or running (i.e. exercising or training) on a natural granular material such as sand. Footwear, as used herein, includes all types of shoes such as athletic shoes (sport specific shoes including running shoes, golf shoes, tennis shoes, baseball cleats, soccer or football cleats, ski boots, etc.), sneakers, training and cross training shoes, and non-athletic shoes such as dress shoes, loafers, boots, sandals, flip-flops, mules, slippers and others.

Aspects of the invention may also be used in conjunction with, or integrated into, any type of foot-receiving device that receives at least some portion of a user's foot. For example, foot-receiving devices may include bindings and/or clips and other devices used for securing feet in snow skis, cross country skis, water skis, snowboards, bicycle pedals, exercise equipment, medical equipment and for receiving feet during play of video games.

Figure 2:
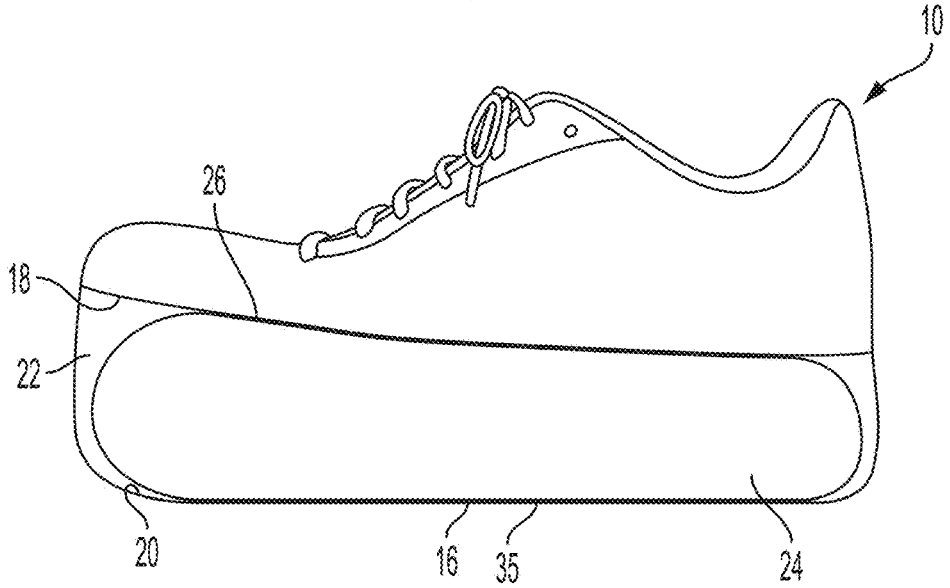
FIG. 2 is a view of the shoe with a midsole guard removed.

FIG. 1 is a side view of a shoe 10 for simulating exercising on a granular material or a combination of granular materials in accordance with the invention. By way of example, the granular material may be a natural granular material such as sand, soil or other natural terrain. For example, the shoe 10 may be used to simulate running on beach sand. The shoe 10 includes a midsole guard element 12 attached between a shoe upper 14 and an outsole 16 of the shoe 10. The midsole guard 12 is fabricated from a flexible material such as rubber or a soft plastic material to enable movement of the shoe upper 14 relative to the outsole 16. Referring to FIG. 2, the shoe 10 is shown with the midsole guard 12 partially removed. An inner surface 18 of the shoe upper 14 is spaced apart from an outsole inner surface 20 to form a chamber 22. In accordance with an aspect of the invention, at least one bladder element 24 is located in the chamber 22. Thus, the midsole guard 12 and bladder 24 (FIG. 1) replace a midsole portion of a conventional shoe. A top surface 26 of the bladder 24 is attached to at least one portion of the shoe upper inner surface 18. In an embodiment, a bottom surface 35 of the bladder 24 is attached to at least a portion of the outsole inner surface 20.

Figure 3:
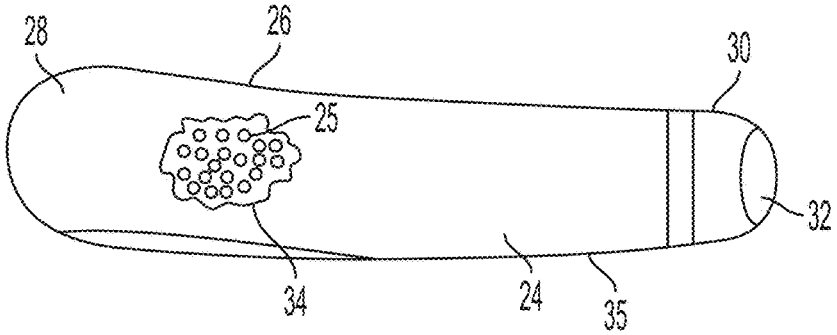
FIG. 3 is a side view of a bladder in accordance with the invention.

Referring to FIG. 3, a side view of the bladder 24 is shown. The bladder 24 is fabricated from a flexible or elastic material and includes a body section 28 and an end section 30 having an opening 32 for receiving synthetic granular material 34 into a cavity 25 of the bladder 24. For example, the synthetic granular material 34 (shown in partial cutaway view) may include synthetic granular beads that are lightweight, semisoft and resilient and fabricated from materials such as soft silicone, polystyrene, rubber, foam rubber, or a combination thereof, for example. Alternatively, gel beads may be used. The synthetic granular material 34 is distributed within the bladder 24 so as to provide a desired simulation of exercising on loose natural granular material such as sand, soil or other natural terrain (i.e. a simulation distribution of synthetic granular material 34). For example, the simulation distribution may include providing a sufficient depth of synthetic granular material 34 to provide the desired simulation. In accordance with an aspect of the invention, the opening 32 is sealed once a desired amount and/or type of granular material 34 is received in the bladder 24 to form a premade bladder 34. In an embodiment of the invention, the bladder 24 may substantially correspond in size to the size of the chamber 22. Alternatively, the size of the bladder 22 may be varied as needed in order to provide a desired simulation of exercising on natural granular material. As will be described in relation to FIGS. 12A-12C, more than one bladder 24 may be used in the chamber 22.

Figure 4:
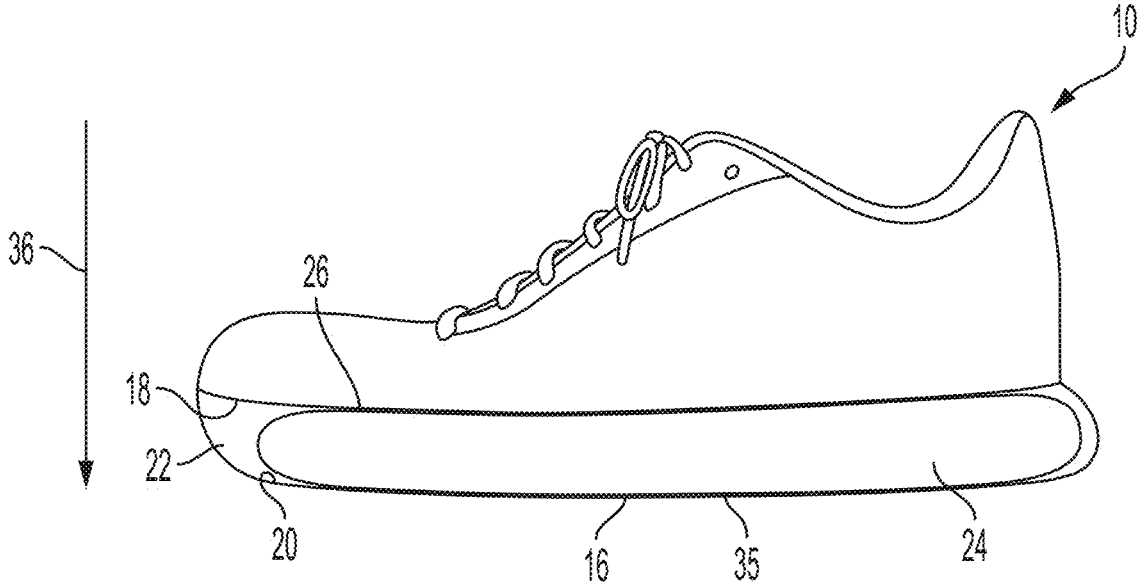
FIG. 4 depicts the shoe in a compressed position.

FIGS. 1 and 2 depicts the shoe 10 in an uncompressed position. In this position, the bladder 24 has an expanded or uncompressed shape and the midsole guard 12 (FIG. 1) is extended substantially upward to form an uncompressed space in the chamber 22 between the shoe upper inner surface 18 and the outsole inner surface 20. Referring to FIG. 4, the shoe 10 is depicted in a compressed position. When a user steps down with their foot as part of their stride, the shoe upper 14 compresses the bladder 24 which in turn displaces the synthetic granular material 34 in the bladder 24 such that the shoe upper 14 sinks into the bladder 24. Displacement of the synthetic granular material 34 decreases resistance to the foot's motion during a push-off portion of the user's stride and thus the ability to obtain traction thereby simulating exercising on natural granular material such as sand. As a result, the runner's leg muscles work harder during the stride and a more demanding cardiovascular workout is achieved than when exercising on a relatively hard surface. The synthetic granular material 34 and bladder 24 are displaced in both a downward direction 36 and in a direction substantially transverse to the downward direction 36 thereby substantially flattening and widening the distribution of the synthetic granular material 34 and bladder 24. When the synthetic granular material 34 and bladder 24 are compressed, the space between the shoe upper inner surface 18 and the outsole inner surface 20 is reduced to form a compressed space and the midsole guard 12 is compressed to place the shoe 10 in the compressed position.

Figure 5:
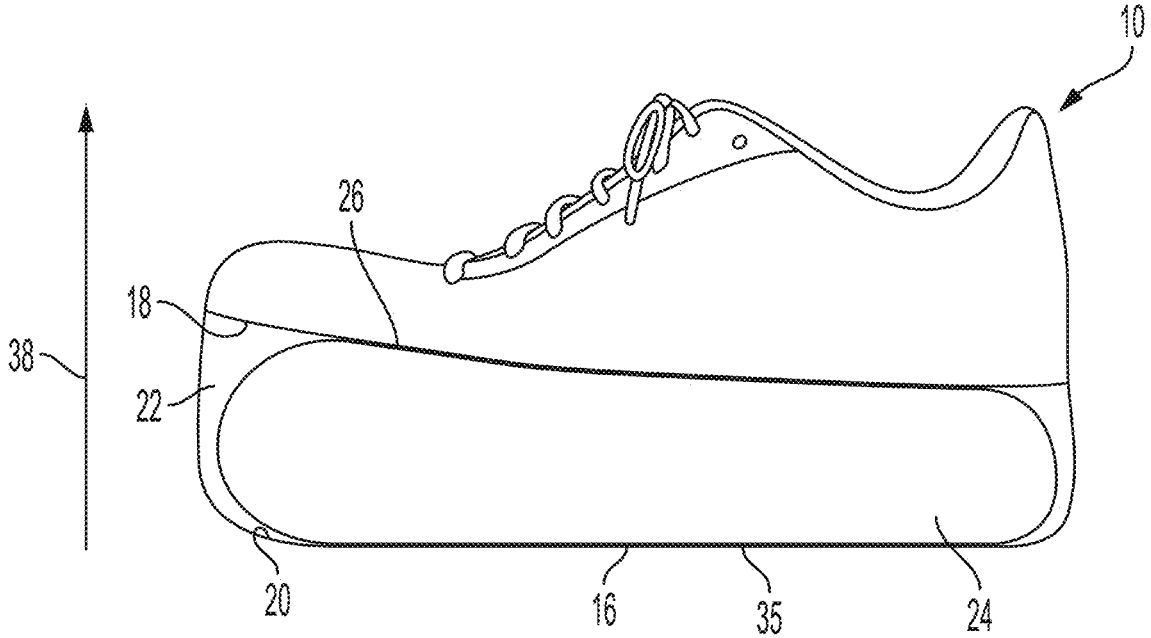
FIG. 5 depicts the shoe in an uncompressed position.

Referring to FIG. 5, the user then lifts their foot as their stride continues thus lifting the shoe upper 14 in an upward direction 38 and placing the shoe 10 in the uncompressed position. This also lifts the attached bladder 24 and causes corresponding expansion of the bladder 24 back to the uncompressed shape. As the bladder 24 expands, the synthetic granular material 34 is redistributed and collected such that the simulation distribution of synthetic granular material 34 is again formed to provide the desired simulation of exercising on natural granular material prior to the next stride. For example, the synthetic granular material 34 is redistributed to again form a sufficient depth of synthetic granular material 34.

Figure 6:
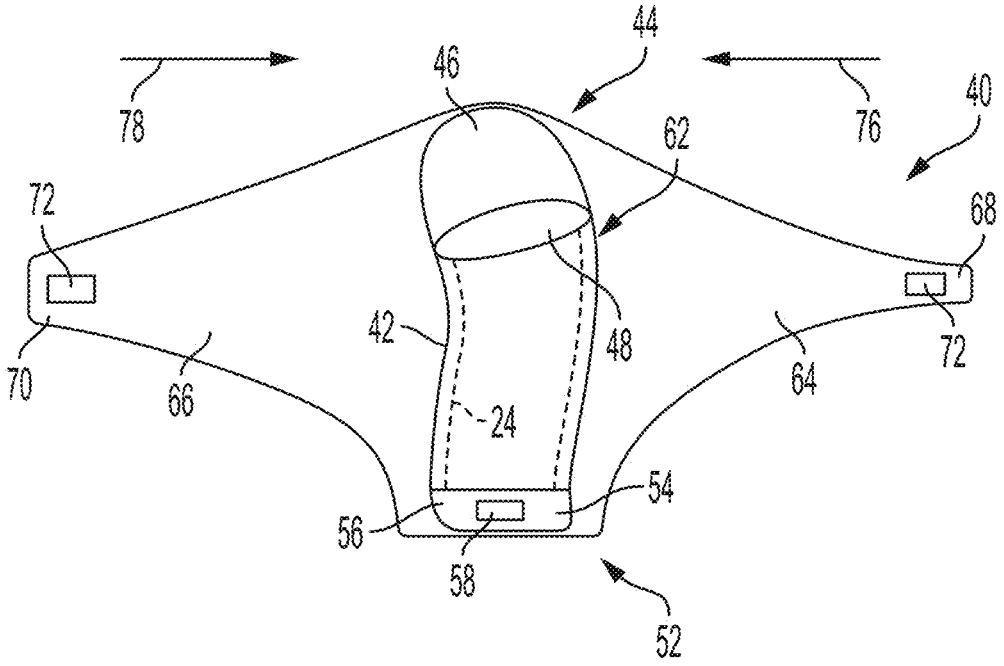
FIG. 6 depicts a shoe attachment for simulating exercising on granular material.
Figure 7:
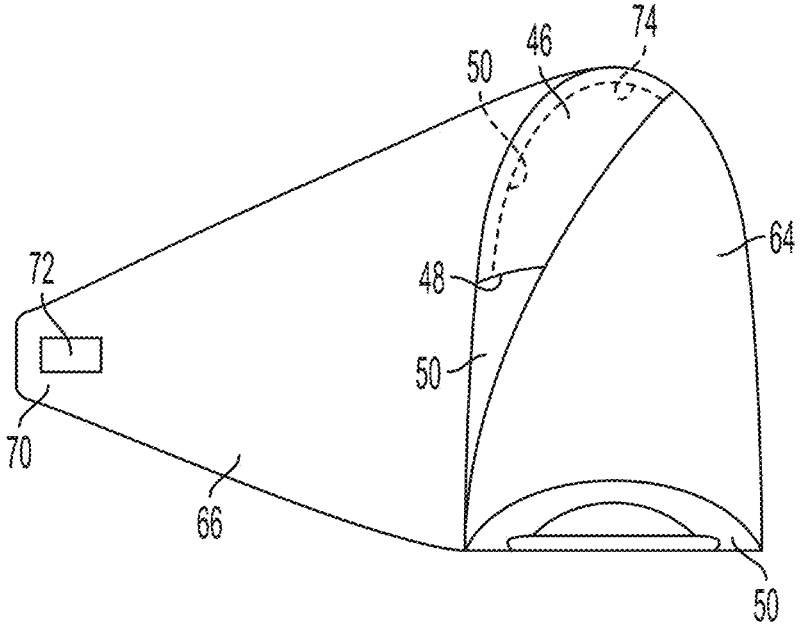
FIG. 7 depicts a front portion of a shoe inserted into a shoe pocket of the shoe attachment.

Referring to FIG. 6, an alternate embodiment of the invention is shown which depicts a shoe attachment 40 for simulating exercising on granular material. The shoe attachment 40 may be removably attached to a conventional shoe, for example. The shoe attachment 40 includes a covering 42 that receives the bladder 24 (shown in dashed lines). The covering 42 may be fabricated from a flexible and expandable plastic or rubber material and corresponds to the shape of the bladder 24. A front portion 44 of the covering 42 includes a shoe pocket 46 having an opening 48 for receiving a front portion of a conventional shoe 50 (FIG. 7). A rear portion 52 of the covering 42 includes a heel strap 54 that receives a heel portion of the shoe 50. An outside surface 56 of the heel strap 54 includes a heel mating element 58 as will be described.

Figure 9:
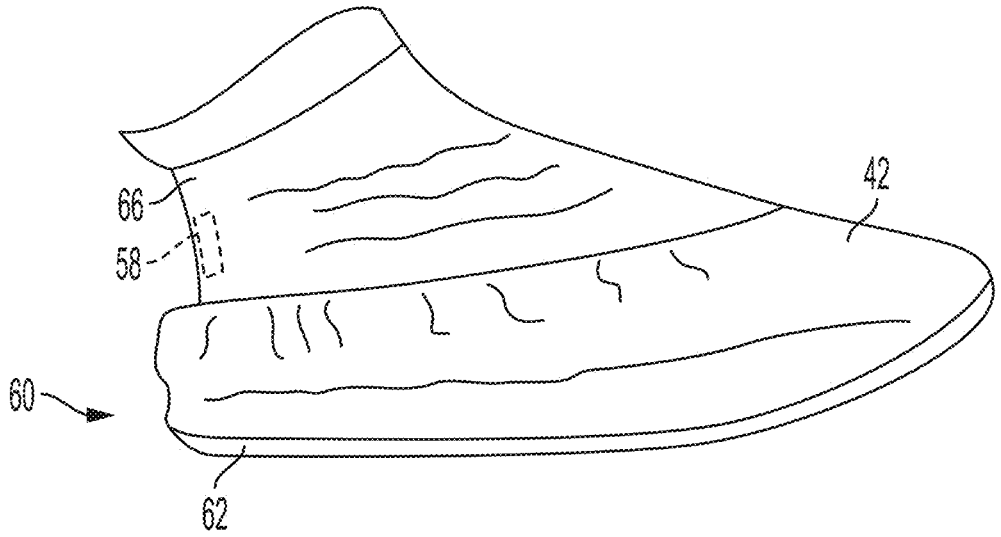
FIG. 9 is a side view of a fully assembled shoe attachment along view line 9-9 of FIG. 8.

A bottom portion 60 of the covering includes a rubberized outsole 62 (see FIG. 9). Referring back to FIG. 6, first 64 and second 66 flexible extension wings extend from the outsole 62. The first 64 and second 66 wings narrow in size as they extend from the outsole 62 to form first 68 and second 70 ends, respectively. In an embodiment, the wings 64, 66 may be manufactured from fabric, cloth, or a flexible elastic material such as rubber. The first 68 and second 70 ends each include an end mating element 72 that removably attaches to the heel mating element 58 located on the heel strap 54. For example, the end mating element 72 located on each of the first 68 and second 70 ends may be a hook part and the heel strap 54 may include a loop part of a hook-and-loop fastener arrangement such as VELCRO® Brand hook and loop fasteners. In alternate embodiments, a single wing or more than two wings may be used.

Figure 8:
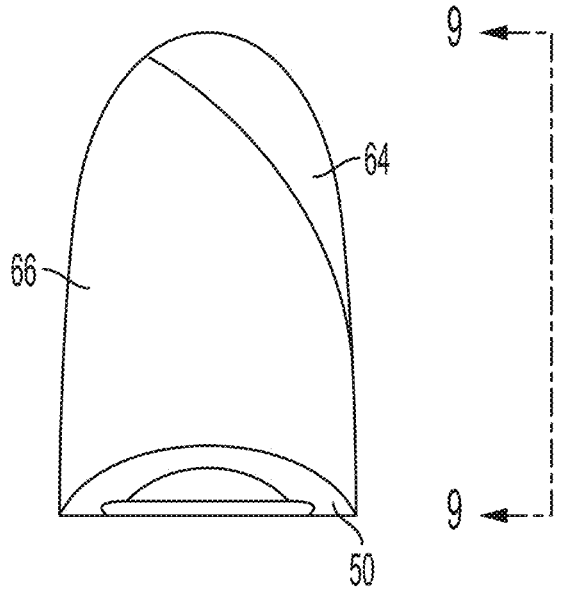
FIG. 8 depicts a second wing of the shoe attachment wrapped partially over a first wing of the shoe attachment.

Attachment of the shoe attachment 42 to the shoe 50 will now be described with reference to FIGS. 6-9. Referring to FIG. 7, a front portion 74 (shown as dashed lines) of the shoe 50 is first inserted into the shoe pocket 46 to position the shoe 50 between the pocket 46 and the heel strap 54. The first wing 64 is then folded in a first direction 76 and wrapped around the shoe 50 such that the first end 68 extends toward the heel strap 54. The end mating element 72 of the first wing 64 is then removably attached to the heel mating element 58. Referring to FIG. 6, the second wing 66 is then folded in a second direction 78 opposite the first direction 76 and wrapped partially over the already wrapped first wing 64 (FIG. 8) such that the second end 70 extends toward the heel strap 54. The end mating element 72 of the second wing 66 is then removably attached to the heel mating element 58 to removably attach the shoe attachment 42 to the shoe 50. Referring to FIG. 9, a side view of a fully assembled shoe attachment 42 along view line 9-9 of FIG. 8 is shown.

In use, the bladder 24 has an expanded or uncompressed shape prior to a user stepping down with their foot. When a user steps down with their foot as part of their stride, the shoe 50 compresses the bladder 24 which in turn displaces the synthetic granular material 34 in the bladder 24 such that the shoe 50 sinks into the bladder. This decreases resistance to the foot's motion during a push-off portion of the user's stride and thus the ability to obtain traction thereby simulating exercising on natural granular material such as sand. As a result, the runner's leg muscles work harder during the stride and a more demanding cardiovascular workout is achieved than when exercising on a relatively hard surface. The synthetic granular material 34 and bladder 24 are displaced in both a downward direction and in a direction substantially transverse to the downward direction thereby substantially flattening and widening the distribution of the synthetic granular material 34 and bladder 24.

The user then lifts their foot as their stride continues thus lifting the shoe 50. This also lifts the attached bladder 24 and causes corresponding expansion of the bladder 24 back to the uncompressed shape. As the bladder 24 expands, the synthetic granular material 34 is redistributed and collected such that the simulation distribution of synthetic granular material 34 is again formed to provide the desired simulation of exercising on natural granular material for the next stride.

Figure 10:
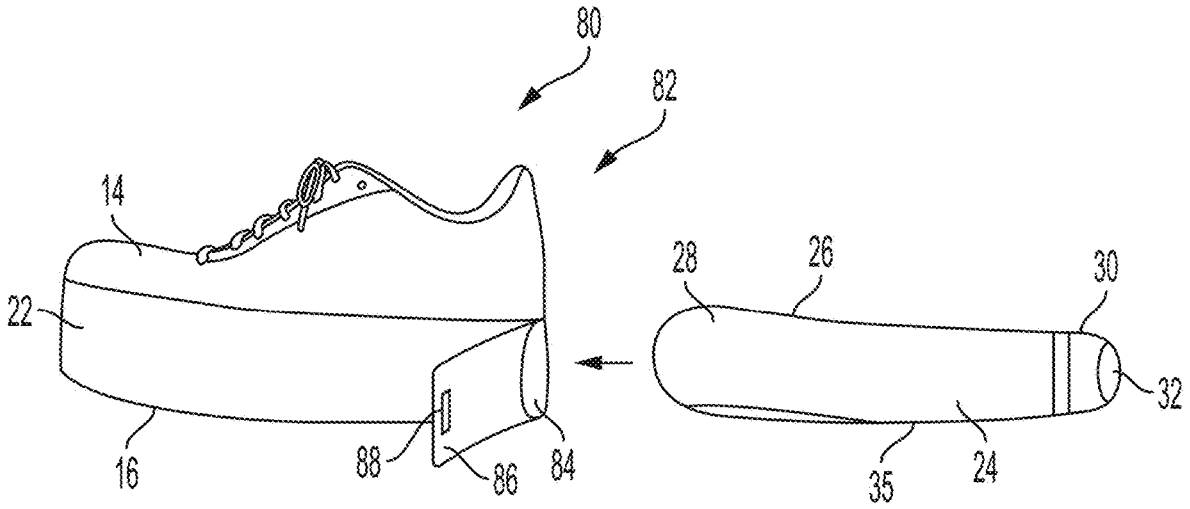
FIG. 10 depicts an alternate embodiment for a shoe that simulates exercising on granular material that includes an aperture for enabling insertion of a bladder into a chamber of the shoe.

Referring to FIG. 10, an alternate embodiment for a shoe 80 for simulating exercising on granular material is shown. A rear portion 82 of the shoe 80 includes an aperture 84 that provides access to the chamber 22. In accordance with the alternate embodiment, this enables insertion of the bladder 24 into the chamber 22 via the aperture 84. The shoe 80 includes a flap 86 that may be rotated relative to the shoe 80 to an open position wherein the flap 86 extends from the shoe 80 (as shown in FIG. 10) to open the aperture 84 and enable insertion of the bladder 24. The flap 86 may also be rotated to a closed position wherein the flap 86 is folded over the aperture 84 to close the aperture 84. The flap 86 may include a flap mating element 88 that removably attaches to a shoe mating element located on the shoe 80 to removably attach the flap 86 in the closed position. For example, the flap mating element 88 may include a hook part and the shoe mating element may include a loop part of a hook-and-loop fastener arrangement such as VELCRO® Brand hook and loop fasteners.

In accordance with an aspect of the invention, a plurality of premade bladders 24 may be fabricated each providing a different simulation of exercising on natural granular material based on a selected amount and/or type of synthetic granular material 34 included in the respective premade bladder 24 and/or a size of the premade bladder 24. Thus, a user is able to insert a premade bladder 24 having desired characteristics to provide a desired simulation of exercising on natural granular material. In addition, a premade bladder 24 already located in the chamber 22 may be exchanged with another premade bladder 24 having a different configuration regarding size, amount and/or type of synthetic granular material 34 or combinations thereof to provide an alternate desired simulation of exercising on natural granular material. Alternatively, the premade bladder 24 may be replaced with non-bladder midsole inserts fabricated from a desired material or combination of materials to provide the user with the option of exercising on different types of surfaces that vary in hardness and viscosity. For example, the inserts may be fabricated from a solid material such as foam or a gel like material as will be described in connection with FIG. 11. Further, solid material midsole inserts may be used alone or in combination with at least one bladder 24 to provide a desired simulation of exercising on natural granular material. Thus, at least one bladder 24 and/or non-bladder midsole insert may be interchanged with another bladder 24 and/or non-bladder midsole insert in the chamber 22 as desired to provide a shoe having an interchangeable midsole configuration.

Figure 11:
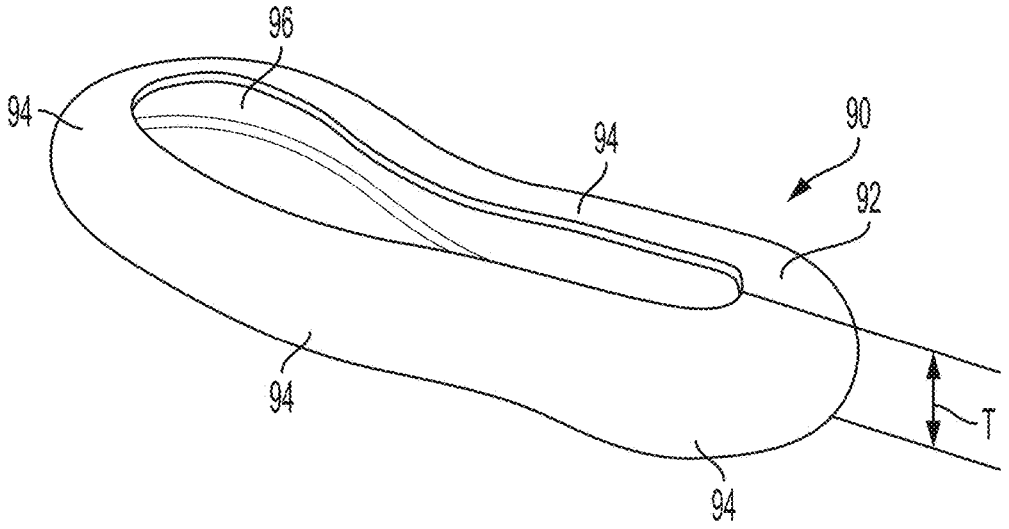
FIG. 11 depicts an insert that may be used in combination with the shoes of the invention or a conventional shoe.

Referring to FIG. 11, an exemplary midsole insert 90 is shown that may be positioned in the chamber 22 of either shoe 10, 80. The insert 90 includes a body 92 defined by rounded edges 94 and sized to accommodate a user's foot. The body 92 includes a cutout portion 96 having a shape that corresponds to the shape of a user's foot. The body 92 may be fabricated from a relatively soft foam material having a predetermined thickness T. In use, a user's foot is received by the cutout 96. The foam and thickness T of the insert 90 are configured to simulate exercising on natural granular material when used in combination with the shoes 10, 80.

Figure 12A:
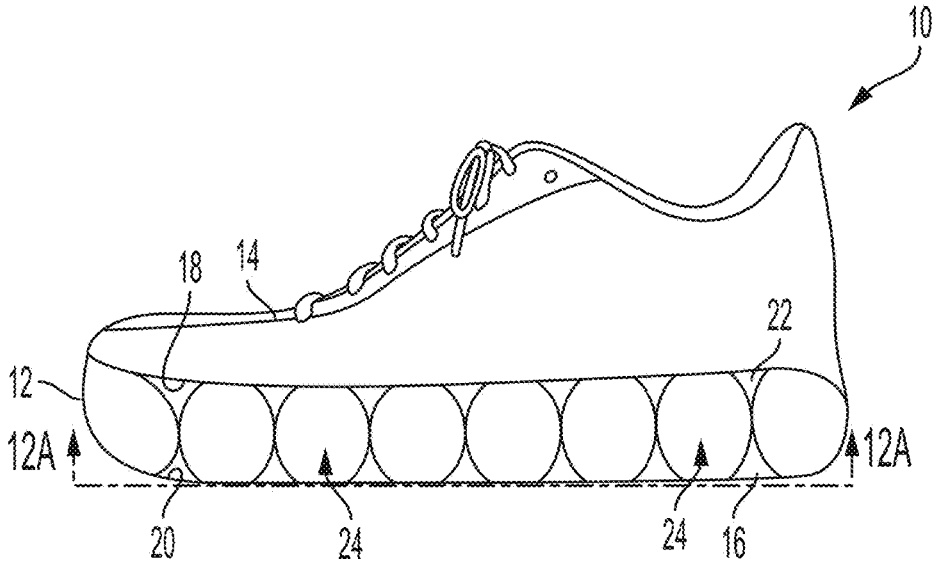
FIG. 12A depicts an embodiment of the invention wherein a plurality of bladders located in a chamber of the shoe.

In another aspect of the invention, more than one bladder 24 may be used in the chamber 22 of the shoes 10, 80 or shoe attachment 40. Referring to FIG. 12A, a plurality of bladders 24 are shown located in the chamber 22. The bladders 24 may have any suitable three-dimensional shape such as sphere, wedge, oval, polygonal and others. Further, more than one shape and/or size may be used for the bladders 24 located in the chamber 22. In an aspect of the invention, the bladders 24 may be attached to each other to form a premade or preassembled bladder assembly 24 for insertion into the chamber 22. For example, the bladders 24 may be attached to each other by sewing or by using an adhesive. As described in connection with FIG. 10, this enables a user to insert a preassembled bladder assembly 24 into the chamber 22 having desired characteristics to provide a desired simulation of exercising on natural granular material. In addition, a preassembled bladder assembly 24 already located in the chamber 22 may be exchanged for another preassembled bladder assembly 24 having a different configuration regarding bladder shape and/or size, the size, amount and/or type of synthetic granular material 34 or combinations thereof to provide an alternate desired simulation of exercising on natural granular material. In addition, each bladder 24 may have respective openings 32 for receiving synthetic granular material 34 to enable use of all or selected bladders 24. Alternatively, other shapes or types of granular material such as sand may be inserted into the bladder 24 to provide a desired simulation.

Figure 12B:
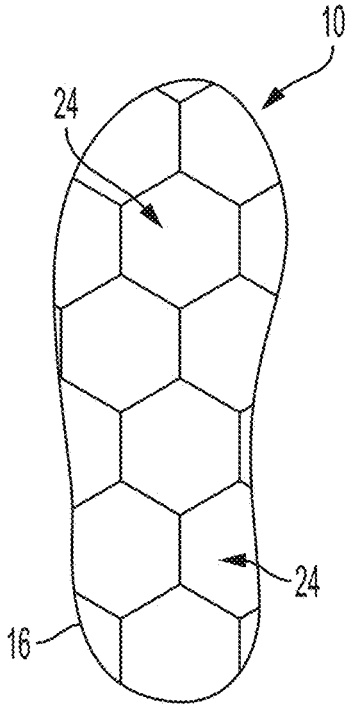
FIG. 12B is an exemplary bottom view of the shoe along view line 12A-12A of FIG. 12A that depicts substantially honeycomb shaped bladders having the same size and located adjacent each other.
Figure 12C:
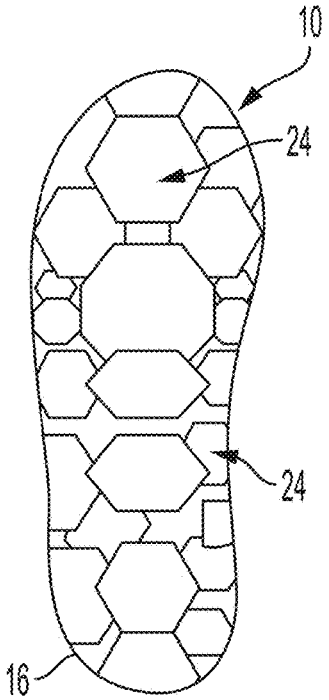
FIG. 12C is an exemplary bottom view of the shoe along view line 12A-12A of FIG. 12A that depicts substantially honeycomb shaped bladders of varying size and arranged in a staggered configuration.
Figure 12D:
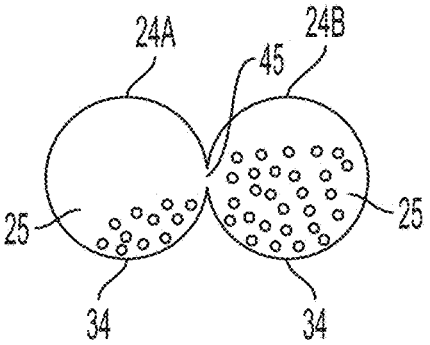
FIG. 12D is an exemplary partial cross-sectional view of adjacent first and second bladders and a passageway formed between the first and second bladders that enables natural granular material to be transferred between the first and second bladders.

Referring to FIGS. 12B and 12C, exemplary bottom views of the shoe 10,80 along view line 12A-12A of FIG. 12A are shown which depict substantially honeycomb shaped bladders 24. In FIG. 12B, the bladders 24 are substantially the same size relative to each other and located substantially adjacent each other. In FIG. 12C, the bladders 24 are of varying size and arranged in a staggered configuration. In another embodiment, hollow chambers that are vertically collapsible may be used instead of, or in combination with, at least one bladder 24 in order to provide a desired simulation of exercising on loose natural granular material. Referring to FIG. 12D, an exemplary partial cross-sectional view of adjacent first 24A and second 24B bladders is shown. In this embodiment, a channel or passageway 45 is formed between the first 24A and second 24B bladders. This enables natural granular material 34 to be transferred between the first 24A and second 24B bladders to provide a desired simulation of exercising on loose natural granular material. In a further embodiment, a valve may be located in the passageway 45 to regulate a flow of granular material 34 between the first 24A and second 24B bladders.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

I claim:

1. A shoe for simulating exercising on natural granular material, comprising:

a shoe upper;

a shoe outsole;

a chamber located between the shoe upper and the outsole;

at least one bladder located in the chamber and attached to the shoe upper, wherein the bladder includes synthetic granular material having a simulation distribution of synthetic granular material for simulating exercising on natural granular material wherein a size of the bladder is compressed by the shoe upper during exercise to displace the synthetic granular material and wherein the size of the bladder is subsequently expanded by upward movement of the shoe upper during exercise to redistribute the synthetic granular material and again form a simulation distribution of synthetic granular material, wherein a rear portion of the shoe includes an aperture that provides access to the chamber to enable insertion of the bladder into the chamber via the aperture; further including a flap that is moveable between an open position wherein the flap extends from the shoe to open the aperture and enables insertion of the bladder and a closed position wherein the flap is folded over the aperture to close the aperture.

2. The shoe according to claim 1, wherein synthetic material is fabricated from silicone, polystyrene, rubber, foam rubber, or a combination thereof.

3. The shoe according to claim 1, wherein the bladder includes an opening for receiving the synthetic granular material.

4. The shoe according to claim 1, wherein the bladder is fabricated from an elastic material.

5. The shoe according to claim 1, wherein the chamber is compressed when the shoe upper compresses the bladder and wherein the chamber expands when the shoe upper moves upward.

6. The shoe according to claim 1, wherein the chamber is compressed when the shoe upper compresses the bladder and wherein the chamber expands when the shoe upper moves upward.

7. The shoe according to claim 1, wherein the bladder is exchanged with an alternate bladder having a different configuration to provide an alternate desired simulation of exercising on natural granular material.

8. The shoe according to claim 1, wherein the bladder is replaced with solid material inserts fabricated from a desired material or combination of materials.

9. The shoe according to claim 8, wherein solid material inserts are used in combination with at least one bladder to provide a desired simulation of exercising on natural granular material.

* * * * *